US007109481B1

(12) United States Patent
Zanon et al.

(10) Patent No.: US 7,109,481 B1
(45) Date of Patent: Sep. 19, 2006

(54) MATRIX-ASSISTED LASER DESORPTION AND IONIZATION (MALDI) SAMPLE PLATE RELEASABLY COUPLED TO A SAMPLE PLATE ADAPTER

(75) Inventors: Stephen Zanon, Campbell, CA (US); James M. Sklenar, Santa Cruz, CA (US)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 11/116,823

(22) Filed: Apr. 28, 2005

(51) Int. Cl.
*H01J 49/00* (2006.01)

(52) U.S. Cl. ..... 250/288; 250/281; 250/398; 250/400; 250/440.11; 73/864.91; 422/99; 422/104

(58) Field of Classification Search ..... 250/281, 250/288, 396 R, 398, 400, 440.1, 492.2
See application file for complete search history.

(56) References Cited

U.S. PATENT DOCUMENTS

| | | | | |
|---|---|---|---|---|
| 5,498,545 | A * | 3/1996 | Vestal | 436/47 |
| 5,770,860 | A | 6/1998 | Franzen | |
| RE37,485 | E * | 12/2001 | Vestal | 436/47 |
| 6,669,910 | B1 * | 12/2003 | Bienhaus et al. | 422/102 |
| 6,670,609 | B1 | 12/2003 | Franzen et al. | |
| 6,716,629 | B1 * | 4/2004 | Hess et al. | 435/420 |
| 6,825,478 | B1 | 11/2004 | McCarthy et al. | |
| 6,827,831 | B1 * | 12/2004 | Chow et al. | 204/604 |
| 6,844,545 | B1 | 1/2005 | Hutchins et al. | |
| 2002/0094533 | A1 * | 7/2002 | Hess et al. | 435/6 |
| 2003/0072684 | A1 * | 4/2003 | Anderson et al. | 422/100 |
| 2003/0124716 | A1 * | 7/2003 | Hess et al. | 435/287.1 |
| 2003/0180807 | A1 * | 9/2003 | Hess et al. | 435/7.1 |
| 2003/0224395 | A1 * | 12/2003 | Jovanovich et al. | 435/6 |
| 2004/0029258 | A1 * | 2/2004 | Heaney et al. | 435/287.2 |
| 2004/0185448 | A1 * | 9/2004 | Lopez-Avila et al. | 435/6 |
| 2004/0228772 | A1 * | 11/2004 | Chen et al. | 422/102 |
| 2004/0266023 | A1 * | 12/2004 | Clark et al. | 436/180 |
| 2005/0116161 | A1 * | 6/2005 | Hafeman et al. | 250/282 |
| 2005/0282755 | A1 * | 12/2005 | Hart et al. | 514/14 |

FOREIGN PATENT DOCUMENTS

| | | |
|---|---|---|
| GB | 2312782 | 11/1997 |
| GB | 2315328 | 1/1998 |
| GB | 2378755 | 2/2003 |

* cited by examiner

*Primary Examiner*—Nikita Wells
*Assistant Examiner*—Bernard E. Souw
(74) *Attorney, Agent, or Firm*—Blakely Sokoloff Taylor & Zafman; Charles B. Katz

(57) ABSTRACT

Embodiments of the present invention describe a MALDI (matrix-assisted laser desorption and ionization) sample plate body that includes a reusable sample plate and a sample plate adapter that are releasably coupled to one another. In one particular embodiment, the sample plate and the sample plate adapter are releasably coupled to one another to form the MALDI sample plate body by a latch formed by a spring-loaded hook within the sample plate adapter and a recess shaped to accept the hook within the sample plate. The MALDI sample plate body may be formed by aligning the sample plate with the sample plate adapter and coupling the sample plate to the sample plate adapter to releasably couple the sample plate to the sample plate adapter.

17 Claims, 13 Drawing Sheets

MATRIX-ASSISTED LASER DESORPTION AND IONIZATION (MALDI) SAMPLE PLATE RELEASABLY COUPLED TO A SAMPLE PLATE ADAPTER

BACKGROUND OF THE INVENTION

1. Field of the Invention

The present invention relates to the field of matrix-assisted laser desorption and ionization (MALDI) mass spectrometry, and more particularly relates to the field of sample plates for MALDI.

2. Discussion of Related Art

Matrix-assisted laser desorption and ionization (MALDI) has proven to be one of the most successful ionization methods for mass spectrometric analysis and investigation of large molecules. The sample to be ionized and analyzed by mass spectrometry is embedded in a solid matrix that greatly facilitates the production of intact gas-phase ions from large, nonvolatile, and thermally labile compounds such as proteins, oligonucleotides, synthetic polymers, and large inorganic compounds. A laser beam (UV- or IR-pulsed laser) serves as the desorption and ionization source. The matrix molecules play a key role in this technique by absorbing the laser light energy and causing sample molecules to be ablated from a portion of the matrix surface. Once the sample molecules are vaporized and ionized they are transferred by ion optics into a mass spectrometer for mass analysis, typically by operation of an ion trap or time-of-flight (TOF) mass analyzer.

In commercial MALDI mass spectrometer instruments, a large number of sample spots are deposited on a sample plate to enable rapid and efficient analysis of multiple samples. MALDI sample plates are typically formed of stainless steel having a highly polished and flat surface. The plates may be adapted to fit into and to be handled by automated handling apparatus employed to transport and position the plates within the mass spectrometer instrument, and optionally to transport the plates between different stations in an automated analysis train (e.g., between automated sample deposition equipment and the mass spectrometer). To enable their use in automated handling apparatus and also to conform their size to standardized dimensions required by other equipment, MALDI sample plates have traditionally been integrated with a base structure. Because a sample plate body consisting of an integral metallic sample plate and base structure is expensive to manufacture, others in the art have proposed alternative constructions. For example, U.S. Pat. No. 6,670,609 to Franzen et al. describes a sample plate assembly consisting of a sample plate permanently bonded to a base structure by a set of cooperating pins and holes. The bonding arrangement purportedly accommodates the differential thermal expansion of the sample plate and base structure, which may be fabricated from different materials. Disposable single-use MALDI plates fabricated from relatively low-cost materials have also been developed as an alternative to conventional sample plates. However, the sample plate construction disclosed in the aforementioned Franzen patent, as well as other alternatives known in the art, generally fail to provide the degree of rigidity and planarity required for reliable operation in a MALDI mass spectrometer.

SUMMARY OF THE INVENTION

Embodiments of the present invention describe a MALDI (matrix-assisted laser desorption and ionization) sample plate body that includes a sample plate and a sample plate adapter that are releasably coupled to one another. In one particular embodiment, the sample plate and the sample plate adapter are releasably coupled to one another to form the MALDI sample plate body by a latch formed by a spring-loaded hook within the sample plate adapter and a recess shaped to accept the hook within the sample plate. The MALDI sample plate body may be formed by aligning the sample plate with the sample plate adapter and coupling the sample plate to the sample plate adapter to releasably couple the sample plate to the sample plate adapter.

In accordance with the foregoing and other embodiments, a MALDI sample plate body is provided that is sufficiently rigid to enable reliable sample analysis in a mass spectrometer, and which allows easy decoupling and recoupling of the sample plate from and to the sample plate adapter.

DETAILED DESCRIPTION

In the following description, numerous specific details are set forth in order to provide a thorough understanding of the present invention. One of ordinary skill in the art will understand that these specific details are for illustrative purposes only and are not intended to limit the scope of the present invention. Additionally, in other instances, well-known processing techniques and equipment have not been set forth in particular detail in order to not unnecessarily obscure the present invention.

A matrix-assisted laser desorption and ionization (MALDI) sample plate and sample plate adapter that are releasably coupled to one another to form a MALDI sample plate body are described herein. The sample plate is releasably coupled to the sample plate adapter. The sample plate may be reusable and may be removed and replaced onto the sample plate adapter with ease because the sample plate is releasably coupled to the sample plate adapter. When coupled to one another, the sample plate and the sample plate adapter form a MALDI sample plate body that behaves substantially as a unitary or permanently bonded structure.

Figure 1A:
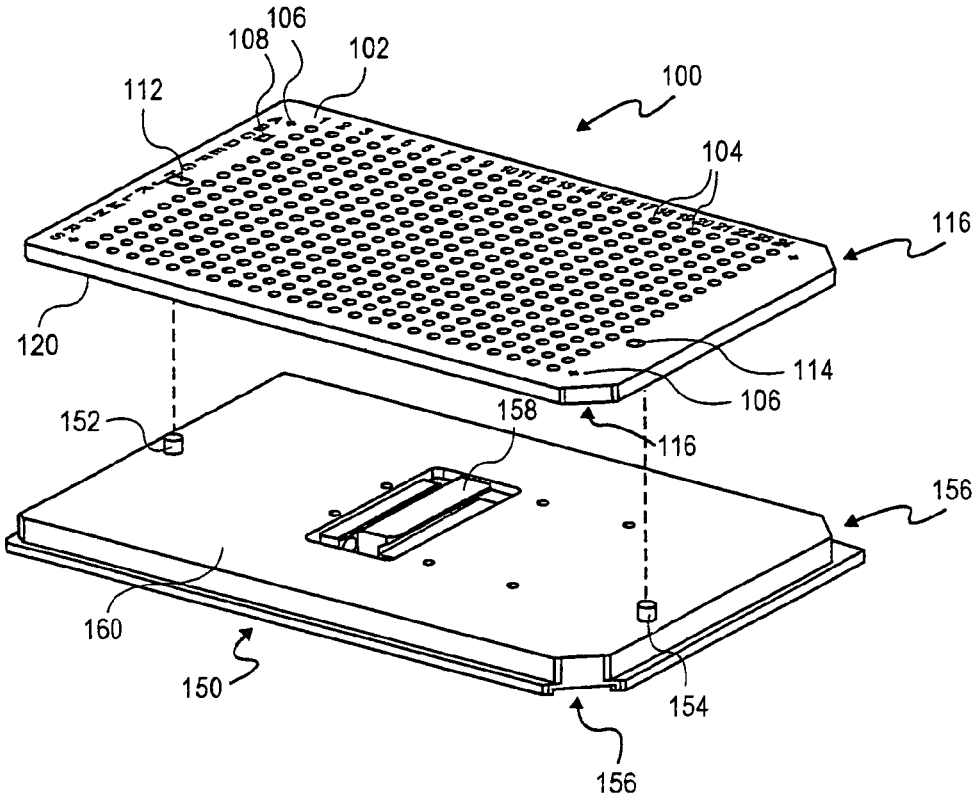
FIG. 1*a* is an illustration of an embodiment of a sample plate and a sample plate adapter, shown in the uncoupled state.

FIG. 1A illustrates a MALDI sample plate 100 and a sample plate adapter 150. The sample plate 100 has a top surface 102 having a plurality of target areas 104 on which sample spots are deposited, and bottom surface 120 opposite to the top surface 102. The bottom surface 120 of the sample plate 100 is designed to come into contact with the platform 160 of the sample plate adapter 150 to form the MALDI sample plate body 180 illustrated in FIG. 1B. The MALDI sample plate body is formed by releasably attaching the sample plate 100 to the sample plate adapter 150. The sample plate 100 and the sample plate adapter 150 are releasably coupled to the sample plate adapter in a manner that inhibits the movement of the sample plate 100 relative to the sample plate adapter 150, the sample plate adapter 150 exerting a downward force on the sample plate in a direction orthogonal to the plane of the sample plate 100.

The sample plate 100 may be reusable and is designed to closely align with the sample plate adapter 150 and to have a flat bottom surface that may come into direct and continuous contact with the sample plate adapter 150 to form the sample plate body 180. In an embodiment, the sample plate 100 is formed of high grade (e.g., 316) stainless steel. Other suitable materials possessing the requisite physical and chemical properties may be substituted for stainless steel. The sample plate material will preferably be free of chemical and physical nonuniformities in order to enable polishing of the plate to a high degree of planarity. The top surface 102 of the sample plate 100 is polished to a mirror finish, substantially free of surface voids. The mirror finish provides a very flat and smooth surface. The high polish assists to prevent samples from spreading and cross contaminating one another and additionally provides more uniform deposition of sample spots on target areas 104. The high planarity also avoids or minimizes misalignment or poor focusing of the laser beams at the sample plane as well as ion flight path length variations, any or all of which could adversely affect the performance of the associated mass spectrometer instrument, particularly where a TOF mass analyzer is used. In an embodiment, the top surface 102 of the sample plate 100 may be polished by machining (e.g., by lapping and/or polishing operations) to a #4 microinch finish, which is a measure of the averaged range of roughness permitted. Therefore, in this embodiment, there will be no more than 4 microinches of variation in the surface profile of the top surface 102. In alternate embodiments, the sample plate 100 may be made from other types of highly polished metals or polycarbonate.

Due to its relatively high expense (arising from the costliness of the material and manufacturing processes), the sample plate 100 is designed for multiple reuse. In practice, following sample analysis, the sample plate 100 is removed from the adapter 150, and the sample plate 100 is washed with the appropriate solvents to remove any residual sample or matrix material. A new set of sample spots may then be deposited on the top surface 102 of the plate, and the plate may be coupled to adapter 150 for subsequent loading into the mass spectrometer instrument. It will be appreciated that this arrangement avoids the need to clean the adapter 150 between each analysis, and further allows multiple sample plates (each prepared separately) to be sequentially utilized in connection with a single adapter plate. The maximum number of reuses of sample plate will be determined by, among other things, the reactivity of the sample and matrix materials, the laser power and beam irradiation patterns, and mass spectrometer performance requirements.

Figure 2A:
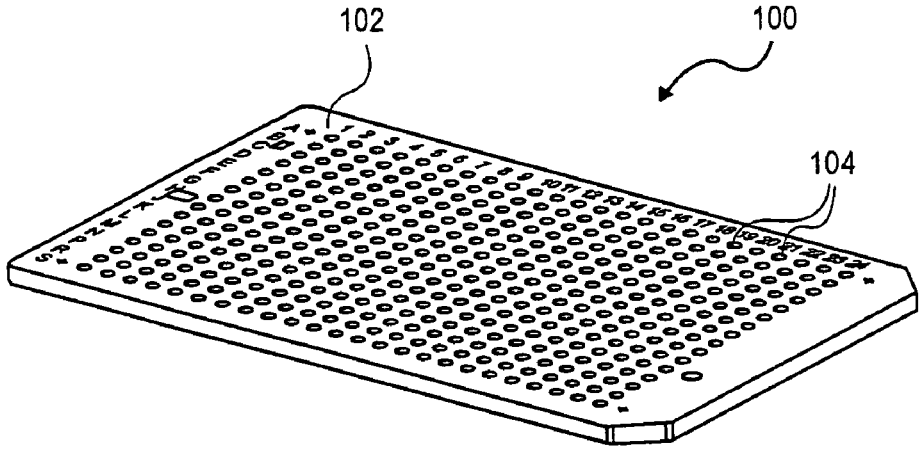
FIGS. 2*a* and 2*b* are illustrations of embodiments of sample plates.
Figure 2B:
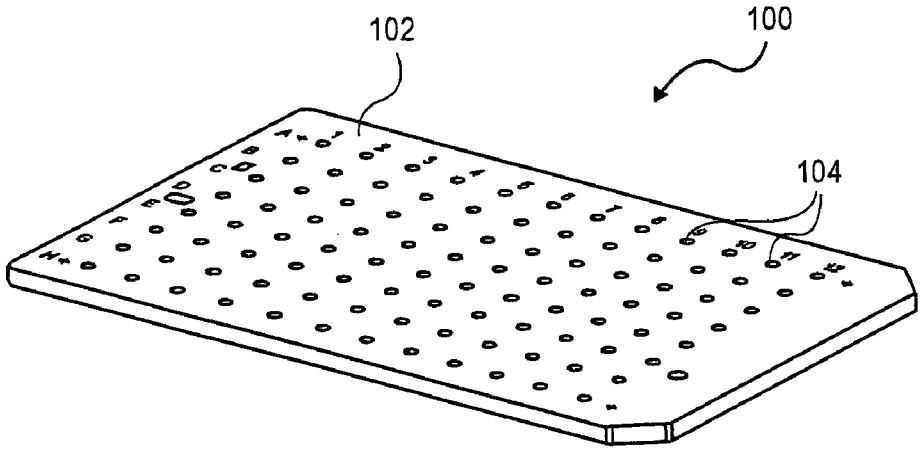

The top surface 102 of the sample plate 100 includes an array of encircled target areas 104 onto which sample spots are deposited. The target areas 104 are spatially discrete and spaced apart by a distance sufficient to prevent mixing of material deposited at adjacent target areas. The number and arrangement of target areas 104 may be based on industry standards and compatibility with other equipment or instruments, such as an automated deposition apparatus ("autospotter"). FIGS. 2A and 2B illustrate two standard target area arrangements. FIG. 2A illustrates a sample plate 100 having 384 target areas 104 arranged so that there are 16 rows (A–S) of 24 target areas 104 each. An alternate embodiment is illustrated in FIG. 2B, where the sample plate 100 has 96 target areas 104 arranged so that there are 8 rows (A–H) of 12 sample spots 104 each.

Figure 2C:
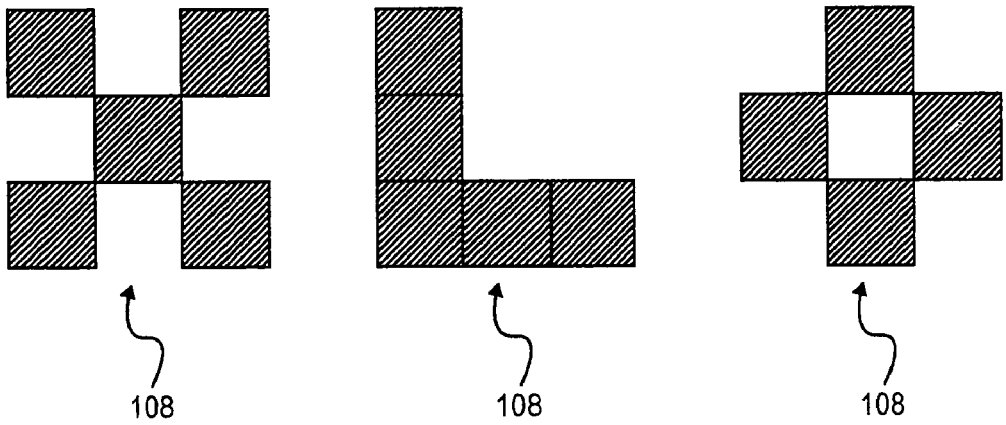
FIG. 2*c* is an illustration of three exemplary unique identifiers.

The top surface 102 of the sample plate may also include calibration marks 106 such as the cross-marks illustrated in FIG. 1A for use by the MALDI source apparatus to precisely position the plate. An identifier may also be included on the top surface 102 of the plate to provide a visual indicia recognizable by a screen digitizer or other image analysis device associated with the mass-spectrometer/MALDI instrument to identify which specific type of plate is being placed in the instrument. The identifier may, for example, identify to the instrument the number and arrangement of target areas 104 on the sample plate 100. In one embodiment, as illustrated in FIG. 2C, the identifier on the sample plate 100 may be a rectilinear grid 108 containing 9 square areas arrayed into three rows and columns. The square areas within the grid 108 may be selectively etched to form different patterns, each pattern uniquely identifying a plate type. FIG. 2C illustrates three different examples of unique identifiers based on the 3-by-3 grid 108. Other forms of visual indicia known in the art, such as bar codes, may be used for this purpose.

The sample plate 100 also includes features to precisely align the sample plate 100 with the adapter 150. One such feature is the positioning of a slot 112 and a hole 114 on the sample plate 100 to align with the first pin 152 and the second pin 154 of the sample plate adapter 150. Additionally, the sample plate 100 may be adapted with two beveled corners 116 and the sample plate 150 similarly adapted with beveled corners 156 to assist the instrument operator to easily orient the sample plate and sample plate adapter correctly by visually matching the corresponding beveled corners. The beveled corners 116 and 156 also aid mechanical handoff of the sample plate body during its insertion into and ejection from the MALDI source. The presence of the beveled corners further ensures that the sample plate body is inserted into the MALDI source in the proper orientation.

In this embodiment, illustrated in FIGS. 1A, 1B, 2A, and 2B, the sample plate 100 has dimensions of 4.870" wide by 3.235" high by 0.116" thick, which correspond to the dimensions of the largest size standard for commercially available sample plates. In alternate embodiments the sample plate 100 may be smaller or changed in other ways to accommodate customer needs. In this way, the sample plate 100 may be specialized for customers to place their own samples on the sample spots 104. The sample plate adapter 150 is valuable because it is interchangeable with a variety of sample plates 100 without having to be re-engineered. In some embodiments it will only be necessary to re-engineer the sample plate 100 to meet customer needs without having to re-engineer the sample plate adapter 150 as well.

Figure 2D:
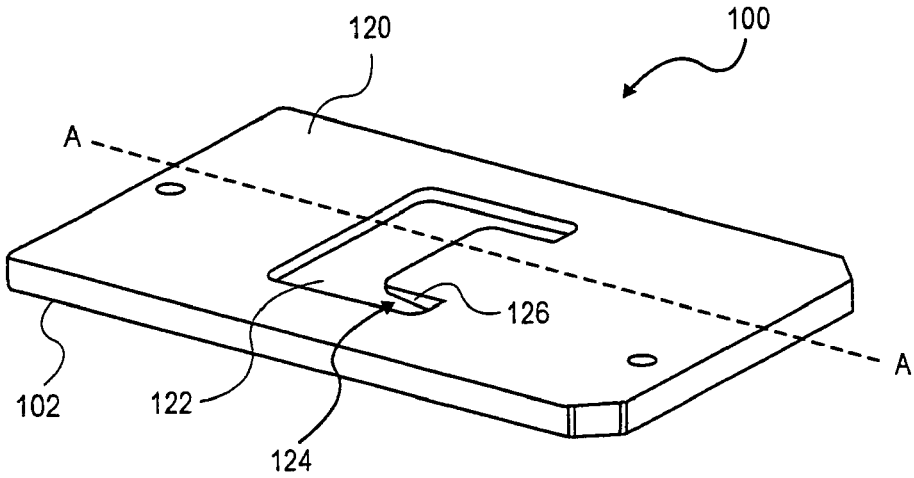
FIG. 2*d* is an illustration of an embodiment of the bottom of a sample plate.
Figure 2E:
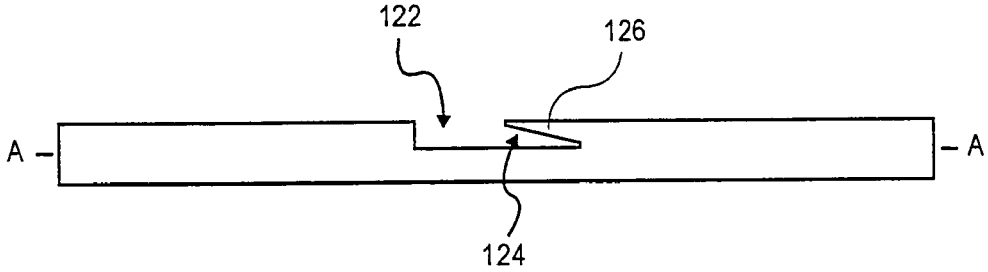
FIG. 2*e* is an illustration of an embodiment of a cross-sectional view of a sample plate.

FIG. 2D illustrates the backside 120 of the sample plate 100. The backside 120 has a very flat surface plane to form a direct and continuous contact with the sample plate adapter 150. The flatness of the backside 120 of the sample plate 100 is also valuable because it may be placed flat on a workbench or within an instrument bed when depositing the samples onto the target areas, or for storage. The backside 120 surface is ground surface machined and lapped with a slurry and a polishing pad to obtain the very flat surface plane substantially free of voids and also to obtain a very precise thickness of the sample plate 100. As indicated above, the typical thickness of the sample plate 100 will be approximately 0.116" (3 mm) with a tolerance of ±0.001". The backside 120 of the sample plate 100 also includes a recess 122 that includes a recessed portion 124 partially defined by taper 126. FIG. 2E illustrates a cross-sectional view of the sample plate 100 along the A—A axis illustrated in FIG. 2D to more clearly illustrate the recess 122, the taper 126 and the recessed portion 124 under the taper 126. The recessed portion 124 is shaped to receive the hook 158 of the sample plate adapter 150 in a slip fit such that the hook engages taper 126 and exerts a downward force thereon, as will be described in further detail below. The taper 126 should be sufficiently thick to prevent it from bending or deforming when the downward force is applied. The recess 122, including recessed portion 124, is formed by machining the backside 120 of the sample plate 100.

Figure 3A:
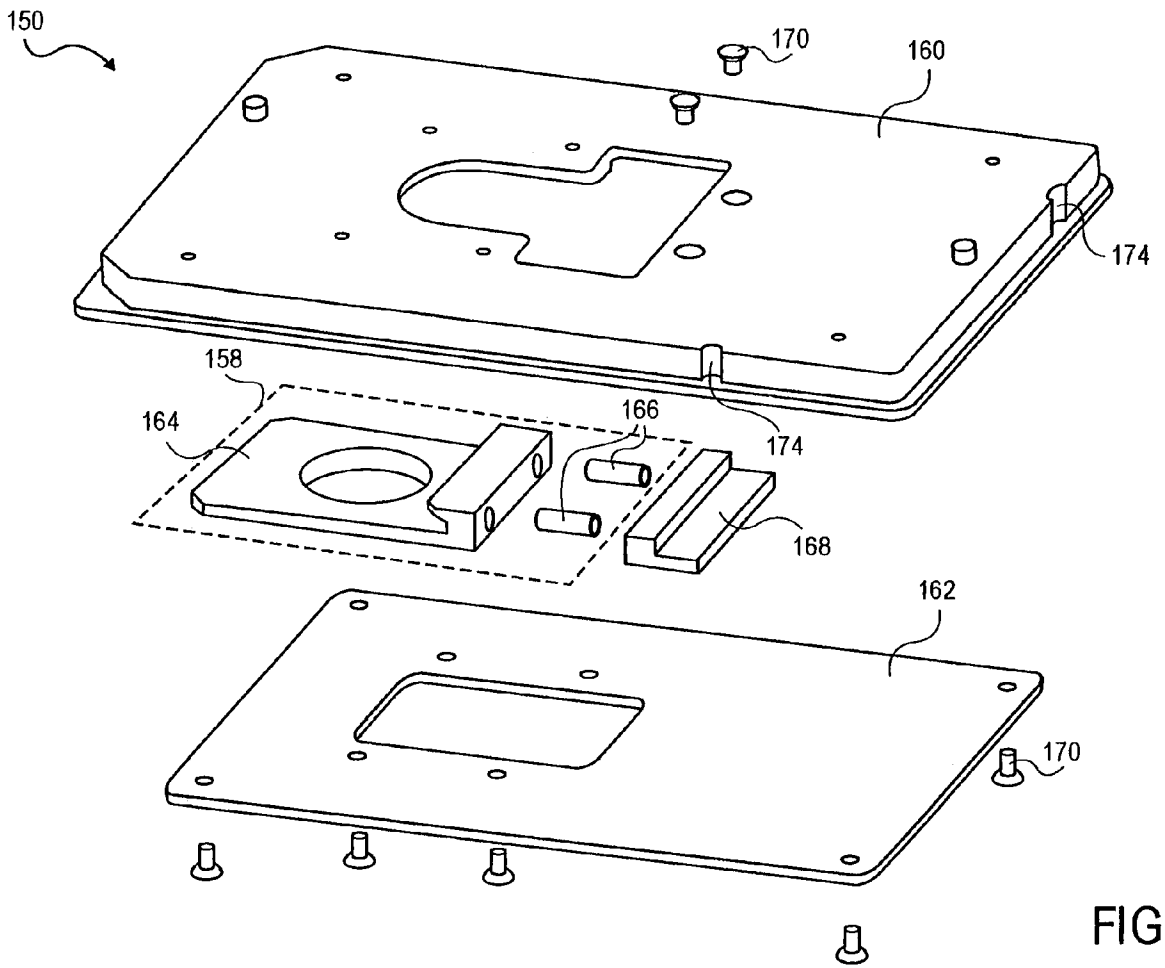
FIG. 3*a* is an illustration of an embodiment of the different components of a sample plate adapter.
Figure 3B:
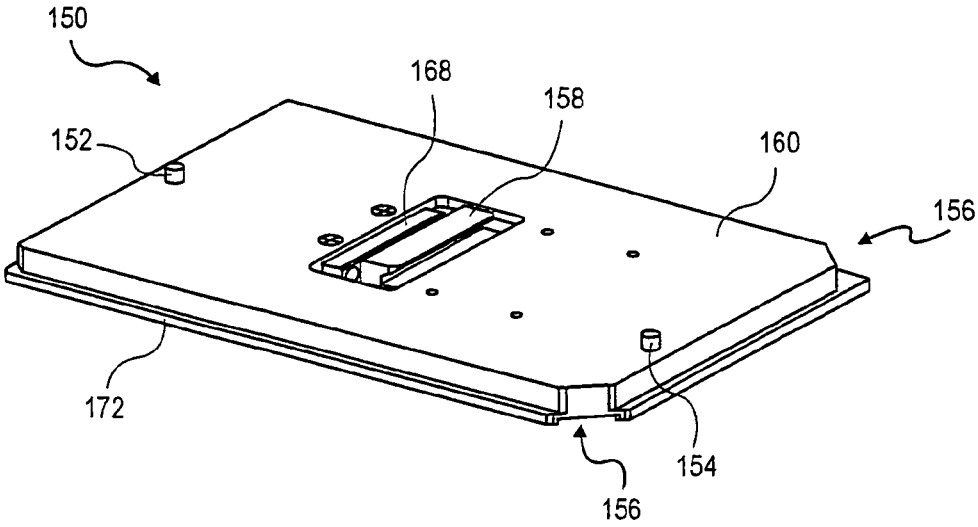
FIG. 3*b* is a top-view of an embodiment of a sample plate adapter.
Figure 3C:
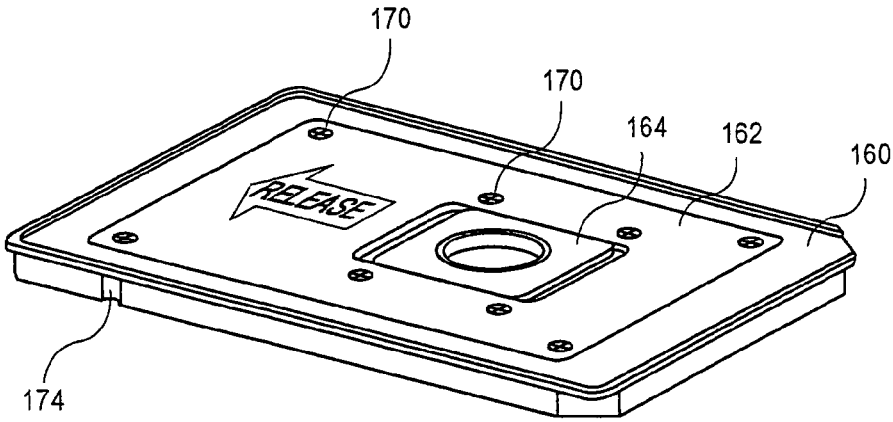
FIG. 3*c* is a bottom-view of an embodiment of a sample plate adapter.

FIG. 3A illustrates the different pieces used to form the sample plate adapter 150. The sample plate adapter 150 is formed of a platform 160, a bottom cover 162, a slide hook 164, a pair of springs 166, a spring block 168, and a plurality of screws 170. Once assembled, the respective pieces illustrated in FIG. 3A form the structure of the sample plate adapter 150 as illustrated in FIG. 3B and FIG. 3C. FIG. 3B illustrates the topside view of the sample plate adapter 150 and FIG. 3C illustrates the bottom view of the sample plate adapter 150. The slide hook 164 and the pair of springs 166 together form a spring-loaded hook 158. When aligned with the sample plate 100, the spring-loaded hook 158 within the platform 160 of the sample plate adapter 150 is opposite the taper 126 on the bottom surface 120 of the sample plate 100. The spring-loaded hook 158 in combination with the taper 126 of the sample plate 100 forms a latch that releasably couples the sample plate adapter 150 to the sample plate 100. In an embodiment, the sample plate adapter 150 may be formed of electroless nickel-plated aluminum, although, the sample plate adapter 150 may be formed of any suitable material, including polymeric materials such as polyetheretherketone (PEEK). In this embodiment, the dimensions of the sample plate adapter are 5.030" wide by 3.365" high by 0.266" thick, the dimensions being selected to fit the largest standard commercially available MALDI sample plate 150.

Figure 1B:
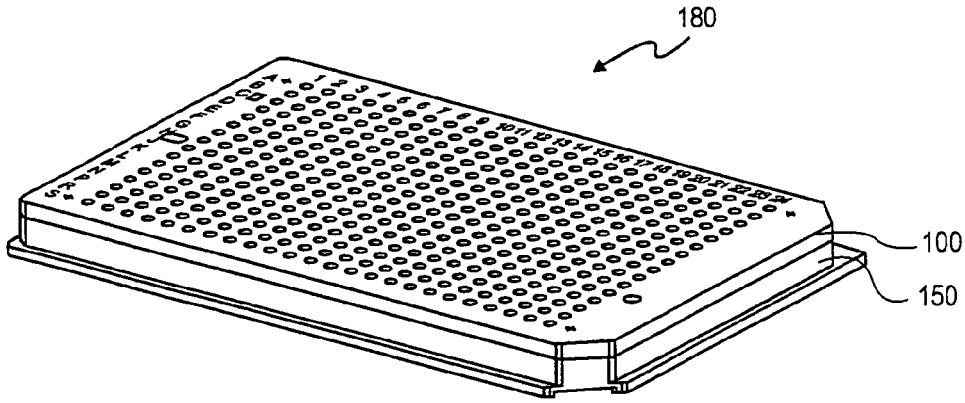
FIG. 1*b* is an illustration of the coupled sample plate and sample plate adapter.

The sample plate adapter 150 also includes alignment features to aid in the alignment of the sample plate adapter 150 with the sample plate 100. The sample plate adapter 150 includes a first pin 152 and a second pin 154 that are perpendicular to the top surface of platform 160 of the sample plate adapter 150 and are positioned on laterally opposite sides of the platform. The first pin 152 and the second pin 154 are positioned to align with the slot 112 and the hole 114 of the sample plate 100 to aid in the proper alignment of the sample plate adapter 150 with the sample plate 100 in the proper orientation. In this embodiment, the first pin 152 and the second pin 154 are not directly across from one another, as illustrated in FIGS. 1B and 3B. Specifically, the first pin 152 is placed at the center of one of the edges of the sample plate adapter 150 and the second pin 154 is placed at a position offset from the center of the opposite edge of the sample plate adapter 150. As will be described later in greater detail, the positions of the first pin 152 and the second pin 154 are designed to align the sample plate 100 with the sample plate adapter 150 in the x-direction and the y-direction of the x-y plane of the sample plate adapter 150 in the proper orientation. The sample plate adapter 150 also includes beveled edges 156 that aid in the visual alignment of the sample plate adapter with the beveled edges 116 of the sample plate 100.

Figure 3D:
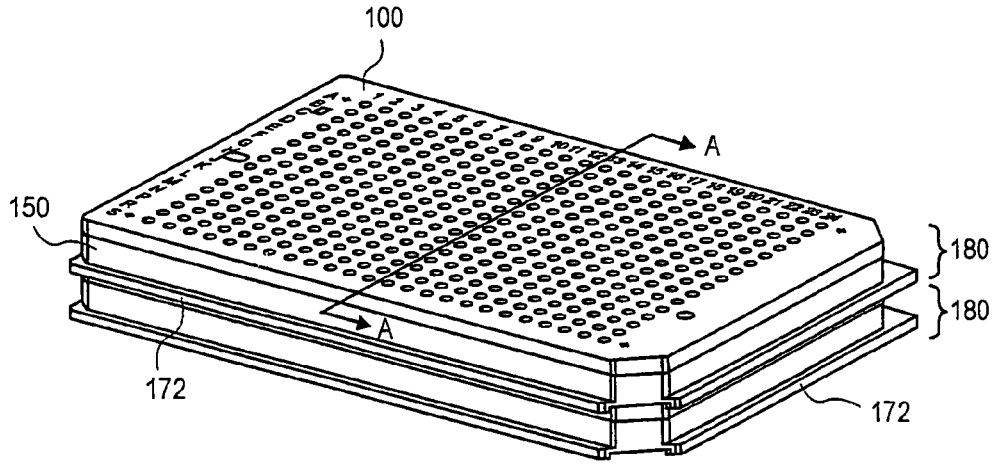
FIG. 3*d* is a cross-sectional view of an embodiment, showing multiple sample plate bodies in stacked relation.
Figure 3E:
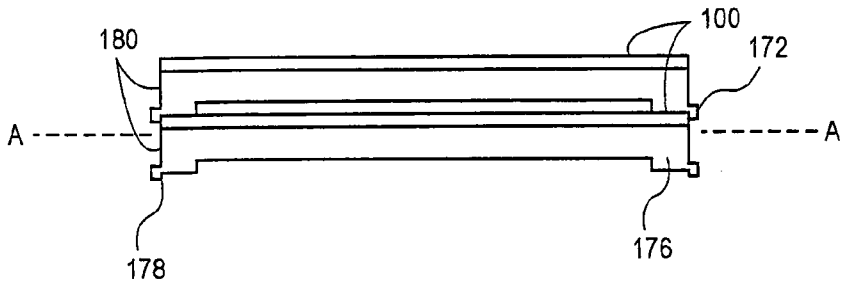
FIG. 3*e* is a lateral cross-sectional view of the stacked plates shown in FIG. 3*d*.

The sample plate adapter 150 may also include features that allow the sample plate adapter 150 to be loaded to and removed from the commercial MALDI source apparatus (such as a vMALDI source available from Thermo Electron) via an automated transport and positioning robot, including detents 174 and lip 172 as illustrated in FIG. 3C. As depicted in FIG. 3D, the design of lip 172 also allows easy and compact storage of multiple sample plate bodies 180 in a vertically stacked relationship. More specifically as illustrated in FIG. 3E, lip 172 defines a ledge 176 that rests only upon the peripheral margins of the top surface 102 of a sample plate 100 stacked immediately below sample plate adapter 150. The depending portion of lip 172 defines a skirt 178 that surrounds the edge surfaces of sample plate 100 and prevents any lateral sliding movement. The remainder of the sample plate 100 top surface is spaced apart from and does not contact the facing surface of the sample plate adapter, thereby preserving the integrity of surface spots deposited on the top surface. By enabling stacking of multiple sample plate bodies, the need to provide a tray structure for storage of multiple trays in a robotic handling apparatus (such as one used to load and remove sample plate bodies to a MALDI source) may be obviated.

The sample plate adapter 150 is designed to precisely align with the sample plate 100 as illustrated in FIG. 1A. As such, the platform 160 of the sample plate adapter 150 is formed to be very flat to come into direct and continuous contact with the bottom surface 120 of the sample plate 100 once the sample plate adapter 150 and the sample plate 100 are placed in contact with one another so that any gaps between the sample plate 100 and the sample plate adapter 150 are minimized. To form the sample plate body 180 that is illustrated in FIG. 1B, the sample plate 100 is aligned with the sample plate adapter 150 as illustrated in FIG. 1A. In an embodiment, the sample plate 100 is placed in the correct orientation with respect to the sample plate adapter 150 by visually matching the beveled edges 116 of the sample plate 100 with the beveled edges 156 of the sample plate adapter 150. The slide hook 164 is then moved to the release position by applying a force (which may be accomplished manually or through mechanical means) to slide it toward spring block 168 and compress springs 166. Preferably, the sample plate 100 is engaged with sample plate adapter 150 by first aligning second pin 154 with hole 114. This step allows first pin 152 to be easily received within slot 112. The slide hook 164 is then returned to the latched position. In this manner, the sample plate is releasably coupled with the sample plate adapter. Removing and replacing the reusable sample plate 100 is easy and efficient because the sample plate 100 is releasably coupled to the sample plate adapter 150. This is valuable for instances where multiple sample plates are to be tested using the sample plate adapter 150 to form the sample plate body 180 or where the reusable sample plate 100 is removed to be cleaned and replaced onto the sample plate adapter with new samples. The sample plate 100 is coupled to the sample plate adapter 150 in such a way as to prevent movement of the sample plate 100 with respect to the sample plate adapter 150 so that the sample plate body acts substantially as a unitary structure. More specifically, the unitary character of the sample plate body is enabled by the precise stacking alignment of the sample plate 100 and the sample plate adapter 150 and by coupling the sample plate 100 to the sample plate adapter 150 to prevent movement between the sample plate 100 and the sample plate body 150 in an x-direction or in a y-direction within the plane of the sample plate body 180 and to further prevent movement between the sample plate 100 and the sample plate adapter 150 in the z-direction that is perpendicular to the x-direction and the y-direction within the plane of the sample plate body 180.

Figure 4A:
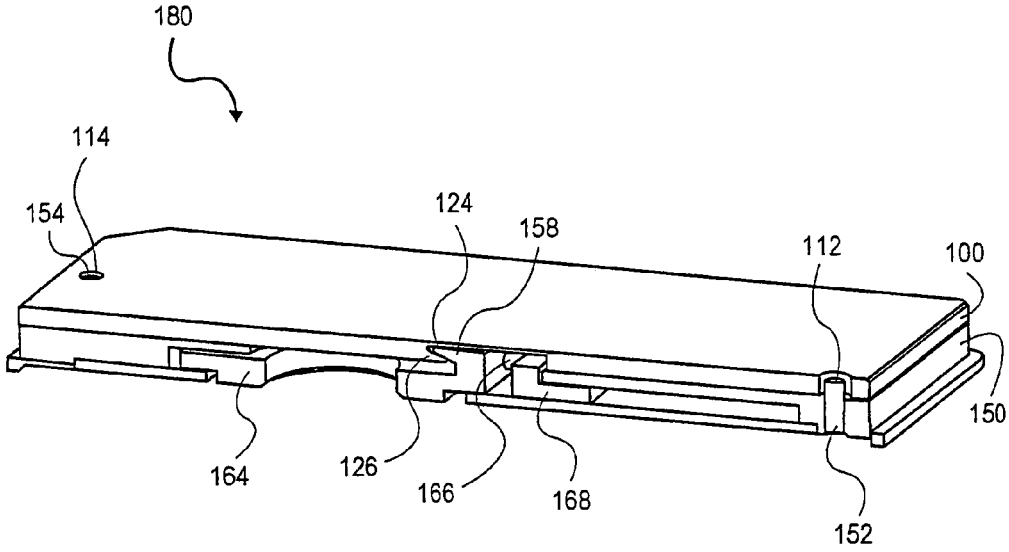
FIG. 4*a* is a cross-sectional view of an embodiment of a sample plate body.

In this particular embodiment, the sample plate 100 is coupled to the sample plate adapter 150 by latching the sample plate 100 to the sample plate adapter 150 to form the sample plate body 180 of FIG. 1B. The latching mechanism is provided by the spring-loaded hook 158 that fits into the recessed-portion 124 of the taper 126. This is illustrated in FIG. 4A, which depicts a cross-sectional view of the sample plate 100 releasably coupled to the sample plate adapter 150 by the action of the spring-loaded hook 158. The sample plate 100 is latched to the sample plate adapter 150 after the two pieces are aligned by removing the force applied to the spring-loaded hook 158, causing it to slide under the taper 126 within the recessed-portion 124 of the taper 126 and exert a continuous contact force in the z-direction. In an alternate embodiment, the latch may be a push-lock latch that would not need to be manually pulled back but instead the hook would push back once pressed against the taper 126. The use of the two pins 152 and 154 and the latch to align and releasably couple the sample plate 100 to the sample plate adapter 150 is valuable because it is easy and efficient to replace the reusable sample plate 100 onto the sample plate adapter 150 and requires no tools and, once assembled, acts as a unitary sample plate body suitable for automation with standard instrumentation. Furthermore, the sample plate and sample plate adapter can only be coupled when placed in the proper alignment and orientation, thereby protecting against any misassembly of the sample plate body.

Figure 4B:
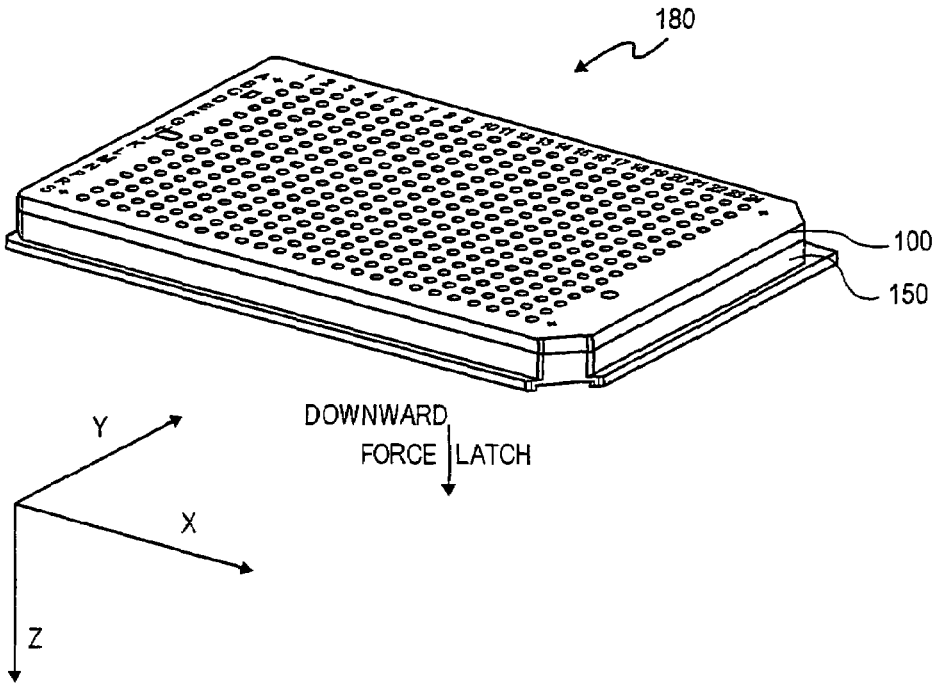
FIGS. 4*b* and 4*c* illustrate the forces exerted on the sample plate body by the latch and by the pins that are offset from one another.
Figure 4C:
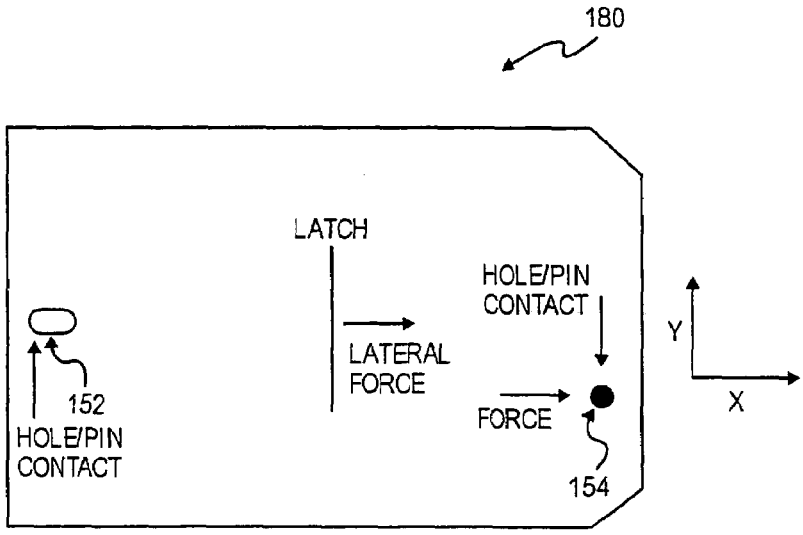

The latch is a two-dimensional lock that applies force in two directions at the same time by pulling the sample plate 100 with a downward force to be in direct and continuous contact with the sample plate adapter 150 and presses with a sideways force the sample plate 100 hole 114 against the pin 154 of the sample plate adapter. The spring-loaded hook 164 latched into the recessed-portion 124 of the taper 126 couples the sample plate adapter 150 to the sample plate 100 to prevent movement of the sample plate with respect to the sample plate adapter 150 in a direction orthogonal to the plane (the x-y plane) of the sample plate 100. FIG. 4B illustrates the downward force exerted by the latch in the direction orthogonal to the plane of the sample plate 100 (z-direction) to bring the sample plate 100 into direct and continuous contact with the sample plate adapter 150 to form the sample plate body 180. In an embodiment, the force exerted by the latch in the direction orthogonal to the plane of the sample plate 100 may be in the approximate range of 5 and 15 lbs. The force exerted by the springs 166 on the spring-loaded hook 158 also couples the sample plate 100 in the x-direction of the sample plate body 180 and presses the hole 114 of the sample plate 100 against the second pin 154 of the sample plate adapter 150 to couple the sample plate 100 with the sample plate adapter 150 in the x-direction as illustrated in FIG. 4C. Rotation of the sample plate 100 within the x-y plane relative to the sample plate adapter 150 is prevented by the force created in the y-direction by the hole 114 pressing against second pin 154 due to the offset positions of the first pin 152 and the second pin 154 of the sample plate adapter 150, also as illustrated in FIG. 4C.

Figure 4D:
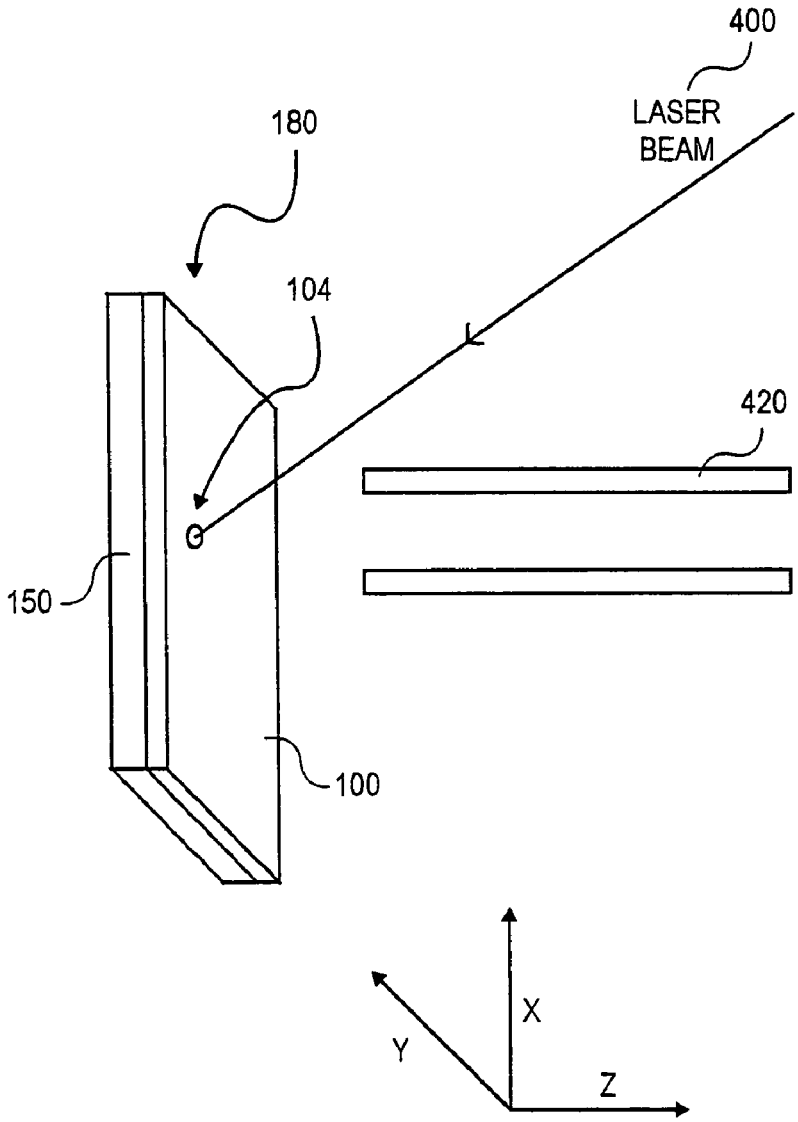
FIG. 4*d* is an illustration of a sample plate body positioned within a MALDI mass spectrometer instrument, showing in particular the alignment of the sample plate body with the laser beam and quadrupole ion guide.

It is highly desirable that the sample plate body 180 acts as a unitary body to prevent any operationally significant movement of the sample plate 100 with respect to the sample plate adapter 150. FIG. 4D illustrates the position of the sample plate body 180 with respect to the laser beam 400 and the quadrupole ion guide 410 of a mass spectrometer. A positioning mechanism (not depicted) is provided to precisely position the sample plate body such that the laser beam is aligned with and focused on selected regions of the sample spot 104. Any movement of the sample plate 100 relative to adapter 150 would cause the beam to be misaligned or misfocused, thereby adversely affecting the desorption and ionization process and compromising mass spectrometer sensitivity. Further, the mass spectrometer performance (particularly in the case of TOF analyzers) may be dependent on carefully regulating the ion flight path length. Any relative movement of the sample plate in the z-dimension (the out-of-plane dimension) would change the ion flight path length, thereby reducing instrument accuracy or requiring recalibration. The foregoing problems are avoided in embodiments of the present invention by inhibiting any operationally significant relative movement of the sample plate.

Figure 5A:
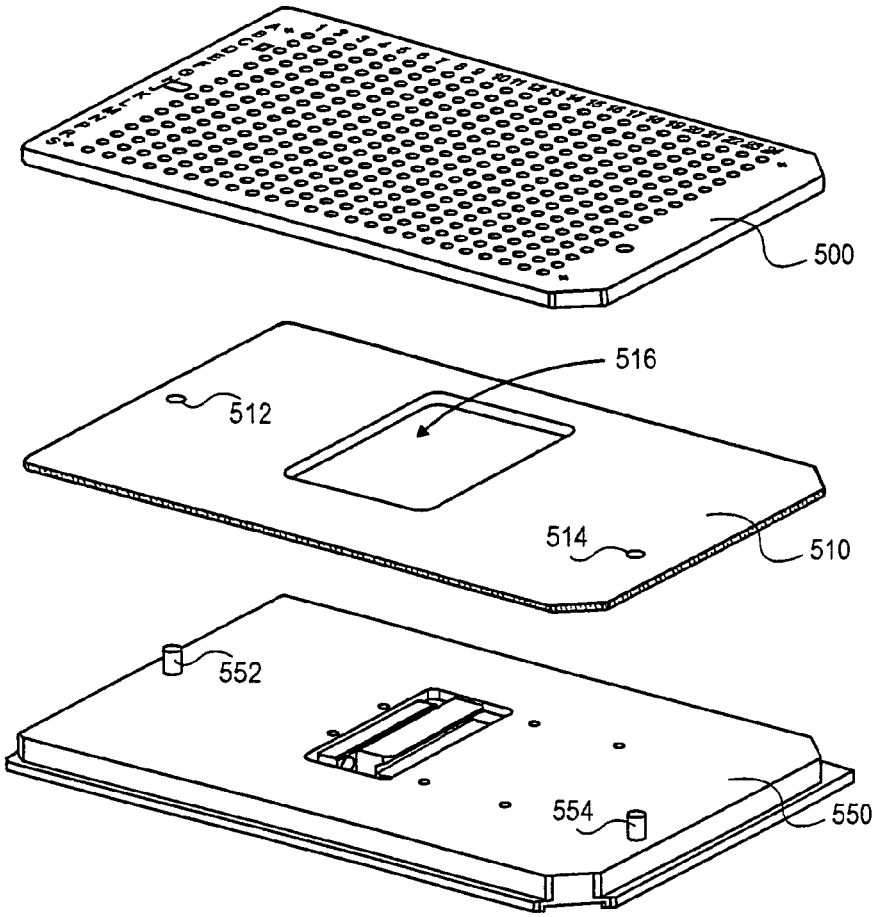
FIGS. 5*a* and 5*b* illustrate a sample plate body formed of three pieces including an insulator disposed in between the sample plate and the sample plate adapter.
Figure 5B:
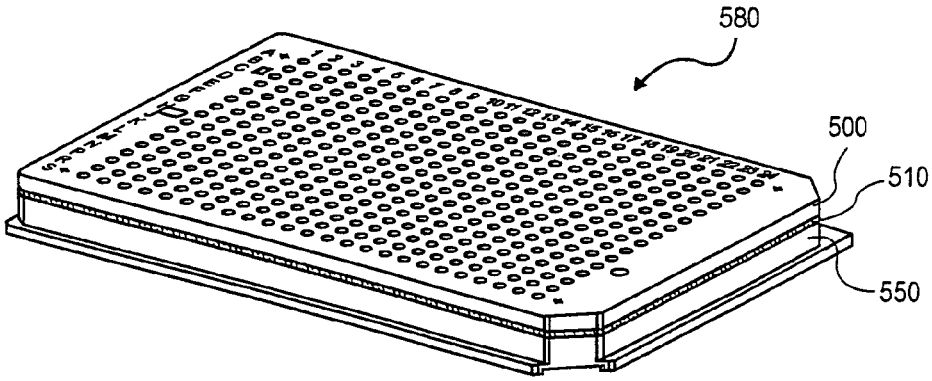

In an alternate embodiment, the sample plate body may include an insulator interposed between the sample plate and the sample plate adapter. The insulator may be included in the sample plate body in instances where it would be advantageous to apply an offset voltage to the sample plate in order to, for example, facilitate the ejection of analyte ions from the irradiated sample spot. The offset voltage applied to the sample plate may be in the approximate range of 40–50 Volts. In such situations, it may be desirable or necessary to electrically isolate the sample plate from the sample plate adapter. FIG. 5*a* illustrates an embodiment where an insulator 510 is provided as a thin separate layer stacked in between the sample plate 500 and the sample plate adapter 550. The insulator may be formed of a plastic material such as PEEK (polyetheretherketone) or polyimide. Alternatively, any other material having suitable insulating properties may be employed. In an embodiment, the thickness of the insulator 510 may be in the range of 0.005–0.010" (0.13–0.26 mm). The insulator 510 of the embodiment illustrated in FIG. 5A is formed to be laterally co-extensive with the sample plate adapter 550 and the sample plate body 500, as illustrated in FIG. 5B. To enable assembly of the sample plate body 580, the insulator 510 also includes holes 512 and 514 to align with the pins 552 and 554 of the sample plate adapter and the holes of the sample plate 500. Pins 552 and 554 will preferably be fabricated from an insulating material to prevent electrical communication between the sample plate and adapter through the pins, which contact the sample plate. Alternatively, electrical contact may be prevented by use of insulating sleeves radially disposed about the pins. The insulator 510 also includes a cut-out portion shaped to conform to the recess formed in the bottom of the sample plate 500. The sample plate 500 and the sample plate adapter 550 may be in direct and continuous contact with the insulator because any thermal expansion may be absorbed by the sample plate body 580 without distorting the sample plate body 580. To prevent electrical communication through the latch, the slide hook and/or other elements of the latch that contact the sample plate should be fabricated from an insulating material such as PEEK. In alternative embodiments, the insulator may be applied as a coating on the platform of the sample plate adapter and/or on the bottom surface of the sample plate. In still another embodiment, the entire sample plate adapter may be constructed from an insulating material such as PEEK.

Figure 6A:
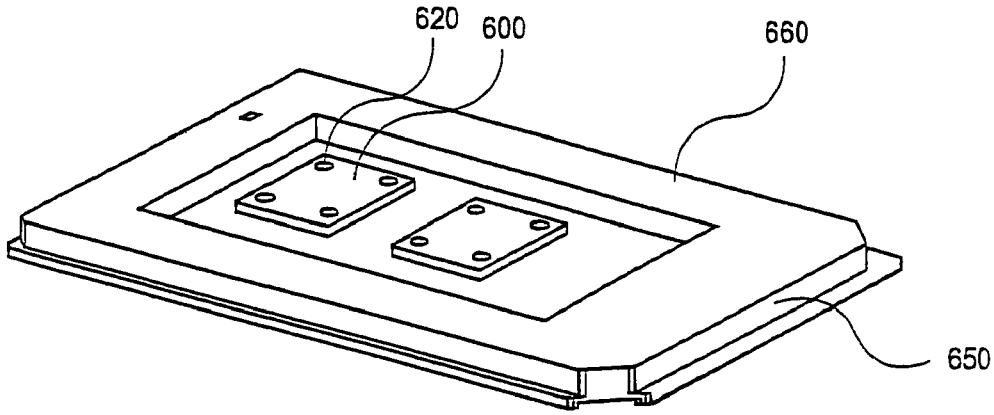
FIGS. 6*a* and 6*b* illustrate alternate embodiments for coupling the sample plate to the sample plate adapter.
Figure 6B:
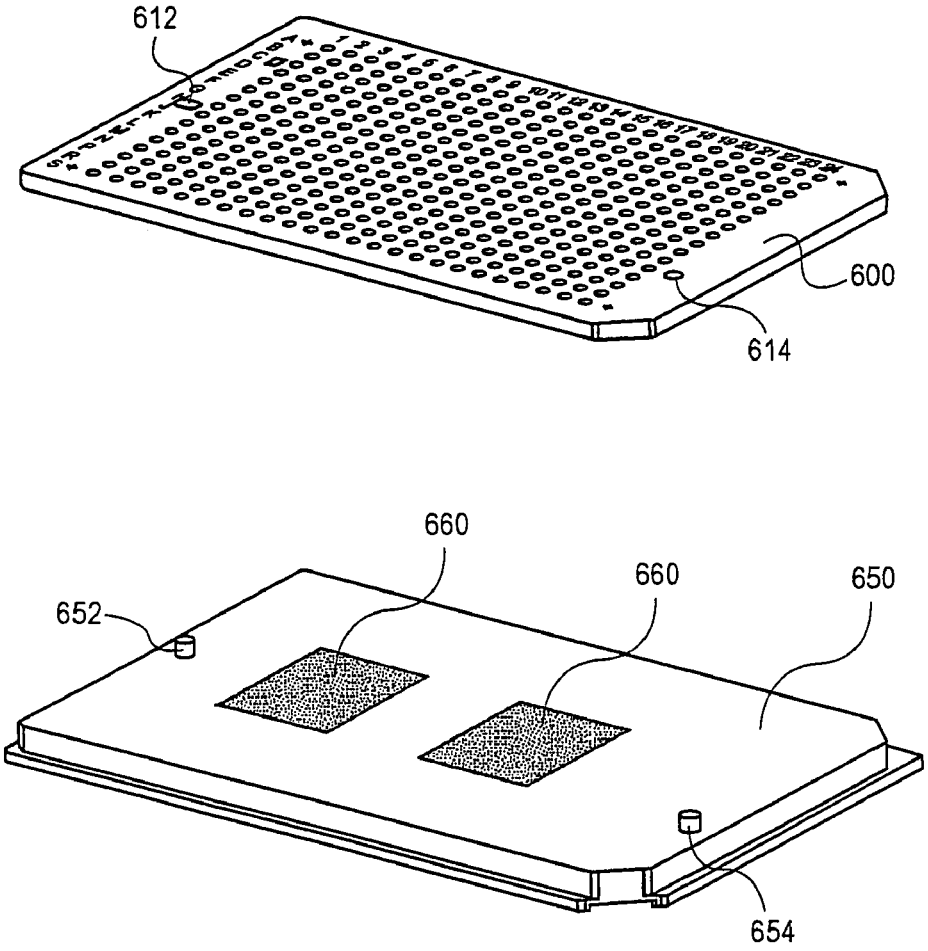

The sample plate may be coupled to the sample plate adapter by means other than the latch mechanism described above and depicted in FIGS. 3 and 4. In one embodiment, as illustrated in FIG. 6A, the sample plate 600 may be coupled to the sample plate adapter 650 by screws 620. The sample plate adapter 650 may be designed to accommodate any size or shape of commercially available sample plate 600. For example, the sample plates 600 illustrated in FIG. 6A are much smaller than the sample plate adapter 650. In this embodiment, the use of the screws 620 may be valuable in aligning and securing smaller sample plates 600 to the sample plate adapter 650. The sample plate adapter 650 may include a raised border 660 which carries fiducials, identifiers, and/or other indicia for use in automated handling of the sample plate body and calibration of the sample plate body's within the MALDI source chamber. FIG. 6B illustrates yet another embodiment where the sample plate 600 is coupled to the sample plate adapter 650 by magnets 660. The magnets 660 may be used alone to couple the sample plate 600 to the sample plate adapter 650, or, as illustrated in FIG. 6B, the magnets may be used in combination with the pins 652 and 654 of the sample plate adapter and the holes 612 and 614 of the sample plate 600 to align the sample plate 600 with the sample plate adapter 650 and to also prevent rotation of the sample plate 600 relative to the sample plate adapter in the x-y plane of the sample plate body. Still further alternative embodiments may utilize double-sided adhesive or similar expedients to releasably couple the sample plate to the sample plate adapter.

While all of the sample plates depicted and described herein take the form of a bare plate, it should be appreciated that the invention may be utilized in connection with sample plates that are adapted with special coatings and/or structures provided to concentrate, process, or otherwise affect the physical or chemical state of sample material deposited on the sample plate. For example, the sample plate may have a patterned polymer layer deposited thereon to control the orientation of ions desorbed from the sample. In another example, the sample plate may have an array of microfluidic chips arranged on the top surface, the chips being configured to receive deposited samples and selectively react with certain components in a predetermined manner (e.g., to concentrate certain sample components).

It is to be appreciated that the disclosed specific embodiments are only meant to be illustrative of the present invention and one of ordinary skill in the art will appreciate the ability to substitute features or to eliminate disclosed features. As such, the scope of the Applicant's invention is to be measured by the appended claims that follow.

We claim:

1. A MALDI sample plate body, comprising:

a sample plate having a top surface for retaining at least one sample thereon and a bottom surface; and a sample plate adapter, releasably coupled to the sample plate in a manner that inhibits the movement of the sample plate relative to the sample plate adapter, the sample plate adapter exerting a downward force on the sample plate in a direction orthogonal to the plane of the sample plate.

2. The apparatus of claim 1, wherein the sample plate adapter further exerts a lateral force on the sample plate in a direction lying in the plane of the sample plate.

3. The apparatus of claim 1, wherein the bottom surface of the sample plate is in direct and continuous contact with the corresponding surface of the sample plate adapter.

4. The apparatus of claim 1, wherein the sample plate adapter further comprises a latch to releasably couple the sample plate adapter to the sample plate.

5. The apparatus of claim 4, wherein the latch comprises a spring-loaded hook.

6. The apparatus of claim 5, wherein the sample plate includes a recess shaped to accept at least a corresponding portion of the spring-loaded hook.

7. The apparatus of claim 5, wherein the spring-loaded hook exerts both a lateral force and a downward force on the sample plate.

8. The apparatus of claim 1, wherein the sample plate adapter further comprises a set of pins projecting upwardly from the upper surface of the sample plate adapter, and the sample plate is adapted with a set of openings spatially corresponding to the set of pins such that the sample plate adapter may be aligned with the sample plate by bringing the set of pins into registration with the set of openings.

9. The apparatus of claim 8, wherein the set of pins includes a first pin and a second pin not directly across from one another.

10. The apparatus of claim 8, wherein the set of openings in the sample plate comprises a slot and a hole.

11. The apparatus of claim 1, wherein the sample plate and the sample plate adapter each have holes for a plurality of screws, the plurality of screws to releasably couple the sample plate to the sample plate adapter.

12. The apparatus of claim 1, wherein the sample plate adapter further comprises magnets to releasably couple the sample plate adapter to the sample plate.

13. The apparatus of claim 1, further comprising an electrical insulator interposed between the sample plate and the sample plate adapter.

14. The apparatus of claim 1, wherein the sample plate adapter is constructed from an electrically insulative material.

15. A MALDI sample plate body, comprising:

a sample plate adapter, the sample plate adapter comprising a spring-loaded hook, a first pin perpendicular to the top surface and a second pin perpendicular to the top surface, the first pin and the second pin positioned on opposite sides of the top surface; and a sample plate, the sample plate comprising a top surface for retaining at least one sample, and a bottom surface including a recess shaped to accept the hook and including a slot and a hole positioned to align with the first pin and the second pin, respectively.

16. The apparatus of claim 15, wherein the first pin and the second pin couple the sample plate adapter with the sample plate to prevent movement of the sample plate with respect to the sample plate adapter in the x-direction and the y-direction within the x-y plane of the sample plate body.

17. The apparatus of claim 15, wherein the spring-loaded hook latched into the recess couples the sample plate adapter with the sample plate to prevent movement of the sample plate with respect to the sample plate adapter in the z-direction perpendicular to the plane of the sample plate.

* * * * *